US007739821B1

(12) United States Patent
Hamme

(10) Patent No.: US 7,739,821 B1
(45) Date of Patent: Jun. 22, 2010

(54) FOLDING PISTOL

(76) Inventor: Wayne Eugene Hamme, 6314 Ingram Rd., San Antonio, TX (US) 78238

( * ) Notice: Subject to any disclaimer, the term of this patent is extended or adjusted under 35 U.S.C. 154(b) by 288 days.

(21) Appl. No.: 12/116,349

(22) Filed: May 7, 2008

Related U.S. Application Data

(60) Provisional application No. 60/938,153, filed on May 15, 2007.

(51) Int. Cl.
*F41A 3/00* (2006.01)

(52) U.S. Cl. ..... 42/8; 42/40; 42/71.02; 42/75.04; 42/69.01; 42/2

(58) Field of Classification Search ..... 42/8, 42/40, 71.02, 75.04, 69.01, 2
See application file for complete search history.

(56) References Cited

U.S. PATENT DOCUMENTS

| | | | | |
|---|---|---|---|---|
| 52,582 | A | 2/1866 | Loomis | |
| 325,053 | A | 8/1885 | Chuchu | |
| 628,142 | A * | 7/1899 | Ericson | 42/52 |
| 837,867 | A * | 12/1906 | Mossberg | 42/8 |
| 970,307 | A * | 9/1910 | Clement | 89/196 |
| 1,059,405 | A | 4/1913 | Sprague | |
| 1,454,454 | A | 5/1923 | Rosier | |
| 3,209,480 | A * | 10/1965 | Mittelsteadt | 42/70.08 |
| 3,838,533 | A | 10/1974 | Ruger | |
| 4,689,908 | A | 9/1987 | McClellan | |
| 4,841,840 | A | 6/1989 | Agner et al. | |
| 4,911,060 | A | 3/1990 | Greenspan et al. | |
| 5,293,708 | A | 3/1994 | Strayer et al. | |
| 5,416,999 | A | 5/1995 | Coury | |
| 5,448,848 | A | 9/1995 | Moller | |
| 5,666,756 | A | 9/1997 | Moller | |
| 5,856,631 | A | 1/1999 | Julien | |
| 5,996,265 | A | 12/1999 | Coury | |
| 6,070,512 | A | 6/2000 | Rohrbaugh | |
| 6,164,001 | A | 12/2000 | Lee | |
| 6,234,058 | B1 | 5/2001 | Morgado | |
| 6,336,282 | B1 | 1/2002 | Buffoli | |
| 6,557,290 | B2 | 5/2003 | Kumler | |
| 6,615,702 | B1 | 9/2003 | Julien | |
| 6,627,012 | B1 | 9/2003 | Tack et al. | |

(Continued)

OTHER PUBLICATIONS

"Custom Carry Accessories for NAA Mini-Revolvers", http://www.naaminis.com/custcry.html.

*Primary Examiner*—J. Woodrow Eldred
(74) *Attorney, Agent, or Firm*—Robert L. McRae; Gunn, Lee & Cave, PC

(57) ABSTRACT

A lightweight, compact, collapsible, and easily concealed pistol. The pistol has a barrel and a handgrip which are pivotally attached to the frame. The barrel is locked to the frame by a barrel lock. Operation of the barrel lock releases the barrel, allowing the barrel to pivot for reloading. In the collapsed position, the handgrip folds to cover the frame and the trigger, which is retracted therein. In the firing position, the handgrip is rotated away from the barrel, and locks in place via grip locks disposed in the frame, and the trigger extends from the frame. The hammer is pivotally attached to the frame. The hammer incorporates a firing pin. A safety located on the hammer retracts the firing pin within the hammer to prevent firing the pistol in the safe position, and extends the firing pin to fire the pistol.

20 Claims, 4 Drawing Sheets

U.S. PATENT DOCUMENTS

| | | | |
|---|---|---|---|
| 6,637,310 | B2 | 10/2003 | Borgwarth |
| 6,789,454 | B2 | 9/2004 | Smith |
| 6,964,123 | B2 | 11/2005 | Vicale |
| 7,086,192 | B2 | 8/2006 | Deros |
| 2002/0121040 | A1 | 9/2002 | Kumler |
| 2003/0109315 | A1 | 6/2003 | Bunting |
| 2004/0020097 | A1 | 2/2004 | Deros |
| 2004/0045209 | A1 | 3/2004 | Nielsen |
| 2004/0134113 | A1 | 7/2004 | Deros et al. |
| 2004/0159033 | A1 | 8/2004 | Rohrbaugh |
| 2005/0011349 | A1 | 1/2005 | Rohrbaugh et al. |
| 2005/0126062 | A1 | 6/2005 | Ghisoni |
| 2005/0262997 | A1 | 12/2005 | Brixius |
| 2005/0268517 | A1 | 12/2005 | Withers et al. |
| 2006/0053673 | A1 | 3/2006 | Murello |

* cited by examiner 18
42
18A
1F
18B
1G
1C
1
1D
1B
1E
1A
9
37
27
1H
1K
4
4H
2B
4J
41
41
4L
2C
17
29
10C
10
4K
2
17B
36
35
2E
2Q
26
2D
17A
4F
2A
2M
2P
4E
4B
28B
23
28A
2F
31
4C
12
6A
6C
28
32
24
8
6B
2N
7
2G
5B
38
8A
7A
2K
2L
21
7B
2J
22
13
5A
6D
14B
15
11B
6E
6
14
3B
8B
6F
6G
15A
5C
33
34
39
20
14A
11A
30
3C
13A
5
3D
11
3A
3E
16
16
100
19B
19
19C 40
3
25
19A
3F
3J

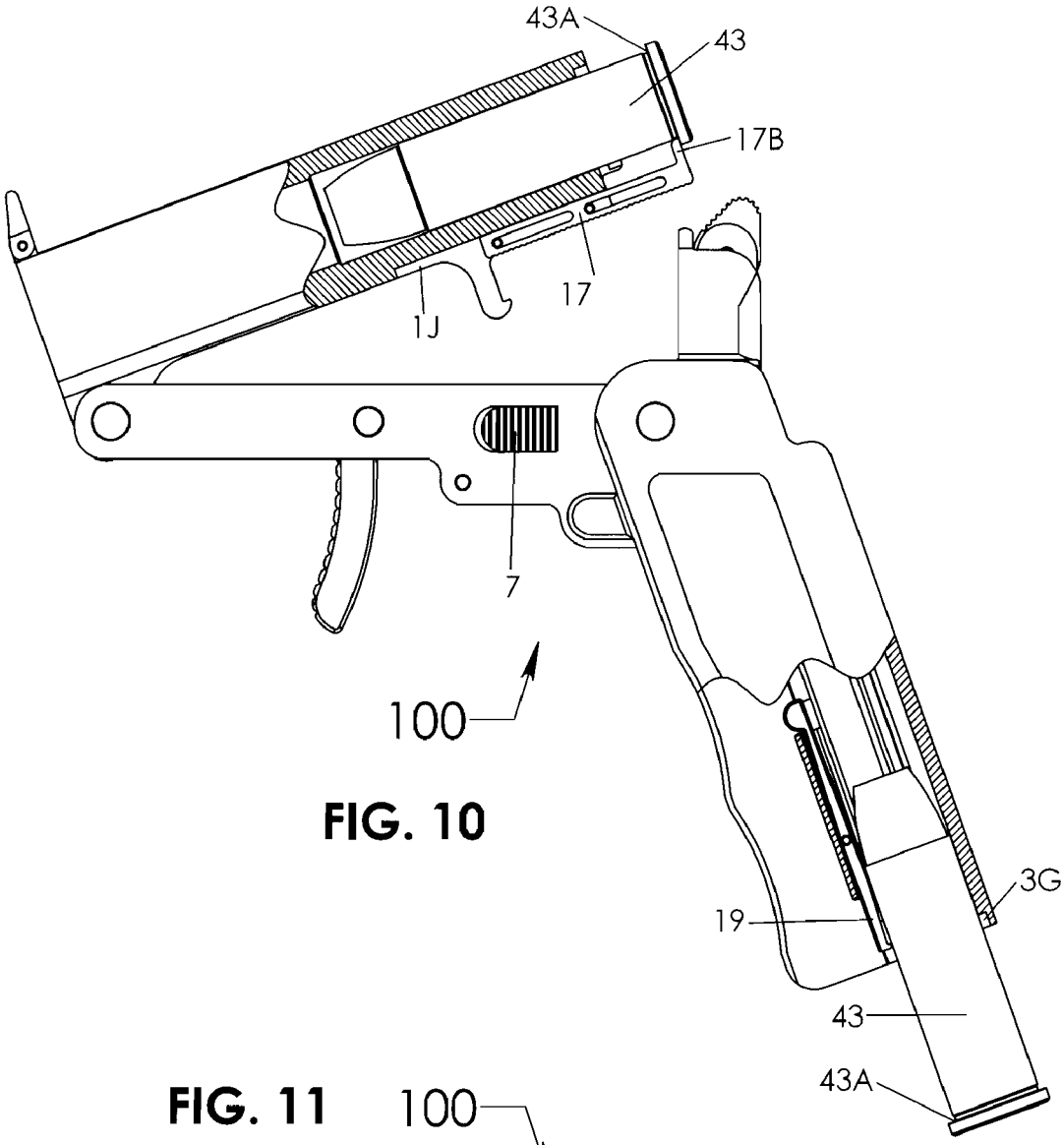
FIG. 10
FIG. 11
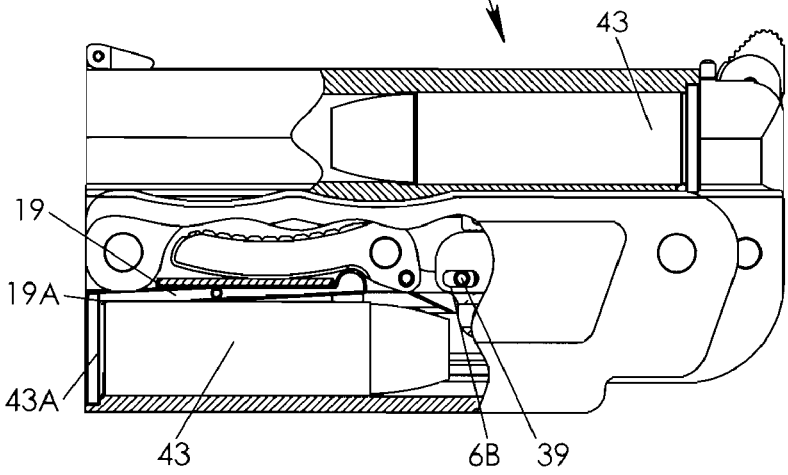

FOLDING PISTOL

This is an original non-provisional application claiming benefit of U.S. Provisional Application 60/938,153 filed on May 15, 2007, which is incorporated herein by reference.

BACKGROUND OF THE INVENTION

1. Field of the Invention

The present invention relates generally to firearms. More specifically, the present invention relates to a compact, light weight and concealable hand held pistol or handgun that has a retractable trigger, a retractable firing pin, and a handgrip pivotally attached to the pistol. The pistol of the present invention is a single-shot pistol, thereby eliminating the need for a magazine or complicated ejection assemblies to eject fired cartridges. The pistol of the present invention is collapsible by pivoting the handgrip at its axis to its concealed position. In its concealed position, the handgrip is adjacent and parallel to the barrel, and at least partially covers the frame of the pistol.

2. Description of the Related Art

Compact, single-shot pistols have existed in the United States since the 1800's. Such pistols, generally known as derringer pistols, have been successful and popular over the years. What makes a derringer type pistol appealing is its compact physical size, which makes the pistol easier to conceal than other typical revolvers and automatics. Such pistols are typically popular among female gun enthusiasts because they are easy to use, and can be concealed in a purse, handbag, or even a coat pocket.

Other compact pistols and revolvers also exist in the market place. Like the derringer pistol, traditional compact handguns are typically desired as a personal protection device because they are easier to conceal and carry. However, all of these handguns suffer the same drawback, namely that of their awkward profile which hinders their ability to be concealed. Compact pistols on the market today still incorporate a traditional style handgrip that protrudes down from the rear portion of the pistol. Although this type of handgrip is designed for ease of use to conform to the average human hand, it does render the profile of the handgun large and cumbersome to carry. Currently, compact handguns on the market are still designed to be carried in a holster due to their awkward shape and excessive weight. Therefore it is desirable to have a pistol that is more compact than existing art that possesses a collapsible handgrip that will allow the pistol to fold down into a slim profile which would enable the pistol to be easily carried without a holster in a pants pocket.

BRIEF SUMMARY OF THE INVENTION

It is therefore an object of the present invention to provide a collapsible, compact, light weight pistol that is both easy to conceal and carry.

It is another object of the present invention to provide a trigger that is retractable within the frame of the pistol.

It is another object of the present invention to provide a firing pin that is pivotally mounted within the hammer and fully retractable within the hammer of the pistol.

It is another object of the present invention to provide a handgrip that is partially hollow to allow the handgrip to cover at least a portion of the frame of the pistol.

It is another object of the present invention to provide a chamber within the handgrip to store an addition bullet or cartridge.

A collapsible pistol that is small, lightweight, and convenient to carry is disclosed. When the pistol is in the collapsed, concealed position, the handgrip folds closed parallel along the length of the barrel, and at least partially covering the frame of the pistol, producing a slender and comfortable profile. The handgrip causes the trigger to pivot in a forward direction, where it is enclosed within a receptacle in the frame of pistol, and covered by the handgrip in the concealed position.

To open the pistol to the firing position, the distal end of the handgrip is rotated outward, away from the muzzle end of the barrel of the pistol until the top portion of the handgrip makes contact with the frame, at which point it becomes locked in the open position by spring loaded grip locks. The spring loaded grip locks are depressibly disposed within the frame and make contact with the edges of the handgrip when the pistol is in the firing position to prevent movement of the handgrip. When the handgrip opens, the trigger, which is pivotally attached to the frame of the pistol and biased in a downward position by a spring, pivots down from inside the frame to be accessible for use.

The hammer is also pivotally attached to the frame and spring loaded to be biased in the uncocked position, and tensioned in the cocked position. In the uncocked position, the hammer contacts a firing surface of the frame. The firing surface has a small hole that receives the firing pin and allows the firing pin to extend through the frame and into the chamber portion of the barrel when the firing pin is engaged in the firing position.

Pulling back on the hammer engages it to a latch which is disposed inside the frame of the pistol, at which point the hammer is poised in the cocked position. There is a safety located on the top portion of the hammer which is in contact with the firing pin. When the hammer is cocked, the safety can be rotated forward, which in turn pivots the firing pin outward from a cavity within the hammer into the firing position.

The trigger is rotatably attached to a toggle, which in turn is rotatably attached to the latch inside the frame. Pulling rearward on the trigger will disengage the latch from the hammer, propelling the hammer and firing pin forward, where the firing pin enters the small hole in the firing surface, firing the cartridge within the barrel.

The barrel is secured to the frame in the concealed position and the firing position by at least one locking tab attached to the bottom surface of the barrel. The locking tab engages a barrel lock slidably disposed within the frame. The barrel lock is biased in a forward, locking position by a spring.

Sliding the barrel lock backward causes the barrel lock to disengage the locking tab, thereby unlatching the barrel from the frame, and allowing the breech end of the barrel to be raised from the pistol to a reloading position. An extractor is slidably attached to the barrel at the breech end and communicates with the breech end of the barrel to lift and expel a spent cartridge from the barrel.

A spare cartridge is stored inside the handgrip by a bullet clip. The bullet clip is a lever attached to a webbed surface formed within the handgrip. The geometry of the webbed surface and the internal shape of the handgrip define a chamber for storing the spare cartridge. The bullet clip is disposed away from the webbed surface and toward the chamber. Depressing the bullet clip within the handgrip releases the spare cartridge from the chamber. Depressing the handgrip locks allows the handgrip to fold back into the concealed position.

BRIEF DESCRIPTION OF THE DRAWINGS

FIG. 10 is a side cut away view of the pistol of the present invention in the reloading position;

FIG. 11 is a side cut away view of the pistol of the present invention in the concealed configuration with the pistol loaded and the spare cartridge contained in the handgrip;

DETAILED DESCIRPTION OF THE INVENTION

Figure 1:
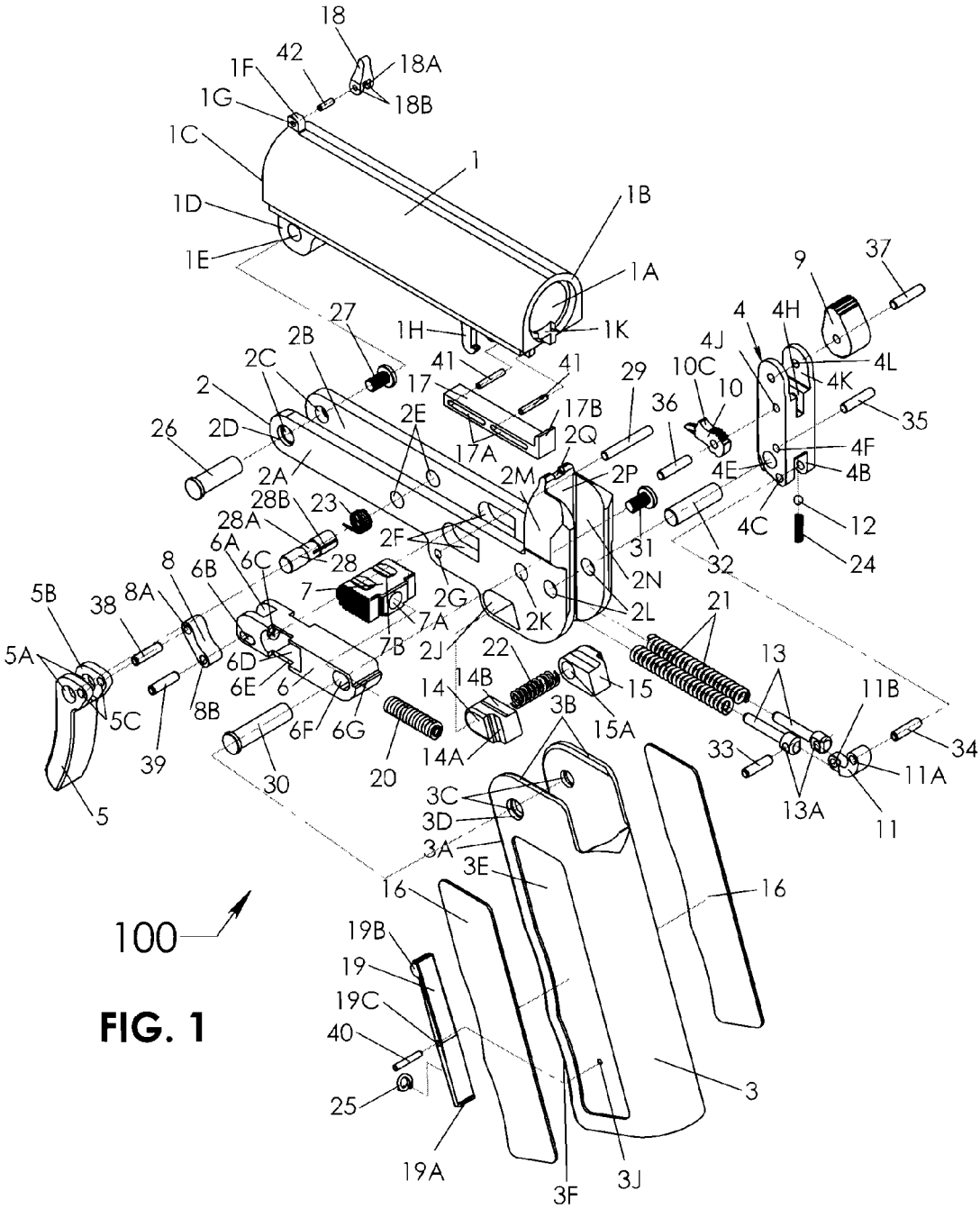
FIG. 1 is an exploded view of the pistol of the present invention.
Figure 2:
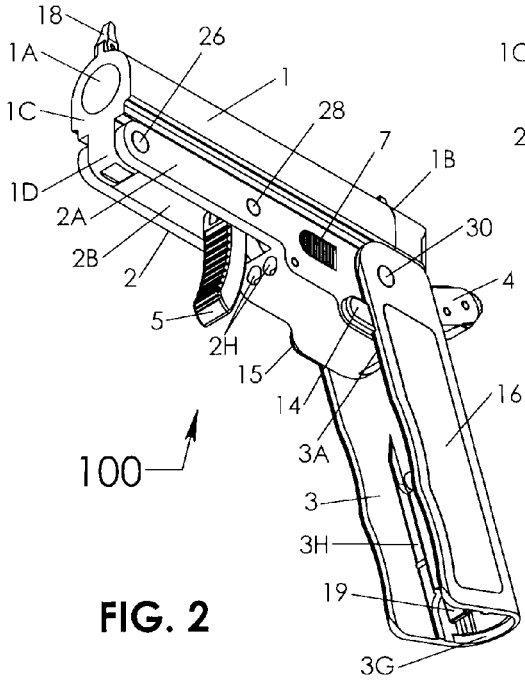
FIG. 2 is a front isometric view of the pistol of the present invention in the firing position with the hammer in the cocked position.
Figure 3:
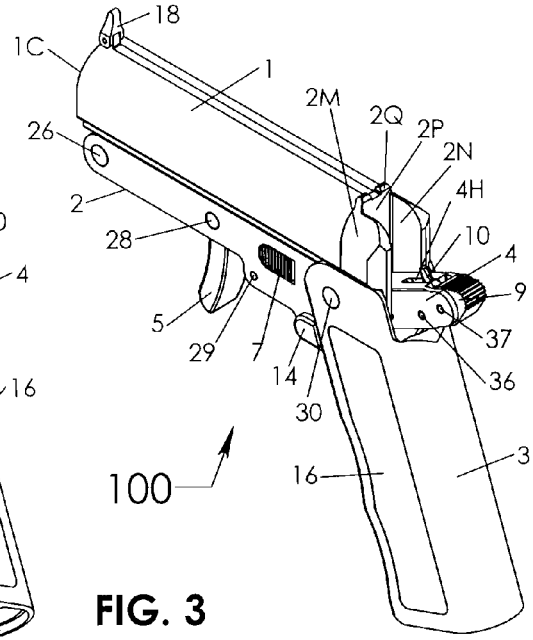
FIG. 3 is a rear isometric view of the pistol of the present invention in the firing position with the hammer in the cocked position and the firing pin in the firing position.

Referring to FIGS. 1 through 5, the collapsible pistol 100 of the preferred embodiment of the present invention is disclosed. The pistol 100 comprises a barrel 1, a frame 2, a handgrip 3, a hammer 4, and a trigger 5. Referring to FIGS. 1, 2 and 3, the barrel 1 is generally tubular in shape with a bore 1A extending the length of the barrel 1. As shown in FIGS. 1 and 2, the barrel 1 has a breech end 1B and a muzzle end 1C. The bore 1A at the breech end 1B of the barrel 1 is formed to the appropriate diameter and size to accept an intended cartridge 43 (see FIGS. 10 and 11).

In the present embodiment, the bore 1A does not have any rifling grooves formed internally at the muzzle end 1C. However, it is understood that rifling (not shown) could be added to the bore 1A, and may be desirable if the pistol 100 is intended to be fired at a target of greater distances or if required to meet federal regulations. If rifling is incorporated into the barrel 1, the diameter of the bore 1A and the rifling grooves (not shown) would be formed to the appropriate size and twist rate for the intended cartridge 43.

Referring to FIG. 2, the barrel 1 is positioned on top of the frame 2, and is pivotally attached to the frame 2 within the two side members 2A and 2B of the frame 2 by a barrel pin 26. As best shown in FIG. 1, barrel 1 has a boss 1D with a clearance hole 1E formed through, which corresponds with mounting holes 2C of side members 2A and 2B. The barrel pin 26 is pressed through the mounting holes 2C in the side members 2A and 2B and the clearance hole 1E in the boss 1D at the bottom portion of the muzzle end 1C of the barrel 1. In the preferred embodiment, the circumference of the mounting holes 2C have shallow counter-bores 2D a seen in FIG. 1. The barrel pin 26 has a small head on one end (see FIG. 1) that fits flush into the shallow counter-bore 2D in the outside surface of the side member 2A. The barrel pin 26 is hollow and contains internal threads. A pin screw 27 has a small head and external threads that thread into the barrel pin 26 through mounting hole 2C on side member 2B. The head of the pin screw 27 rests in the counter-bore 2D (not shown) of mounting hole 2C of side member 2B to remain flush with the frame 2. The attachment of the barrel 1 to the frame 2 by the barrel pin 26 and the pin screw 27 provides the pivotal axis on which the barrel 1 hinges or pivots from the closed, firing position as shown in FIGS. 2 and 3 to the open, reloading position shown in FIG. 10.

As shown in FIGS. 1, 2 and 3, a folding sight 18 is located on the top of the barrel 1 toward the muzzle end 1C, and folds down parallel with the barrel 1 in the concealed position (see FIGS. 4, 5 and 11), and opens perpendicular to the barrel 1 for use in the firing position as shown in FIG. 3. Referring to FIG. 1, the sight 18 contains a slot 18A that straddles a small embossment 1F at the top of the muzzle end 1C of the barrel and is attached to the barrel 1 and held in place by the sight pin 42 that is pressed through two mounting holes 18B on each side of the sight 18 and clearance hole 1G of the barrel 1. Referring to FIGS. 1 and 3, a rear sight 2Q is located on top of the firing surface 2P of frame 2. When in the pistol 100 is in the open, firing position, the sight 18 viewed in alignment with rear sight 2Q form visual sights for aiming the pistol 100.

Figure 6:
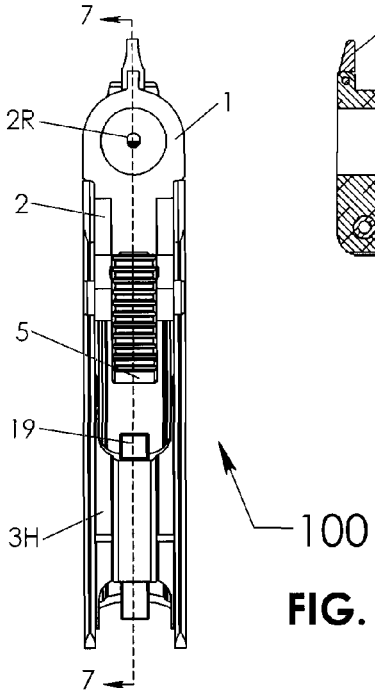
FIG. 6 is a front view of the pistol of the present invention in the firing position.
Figure 7:
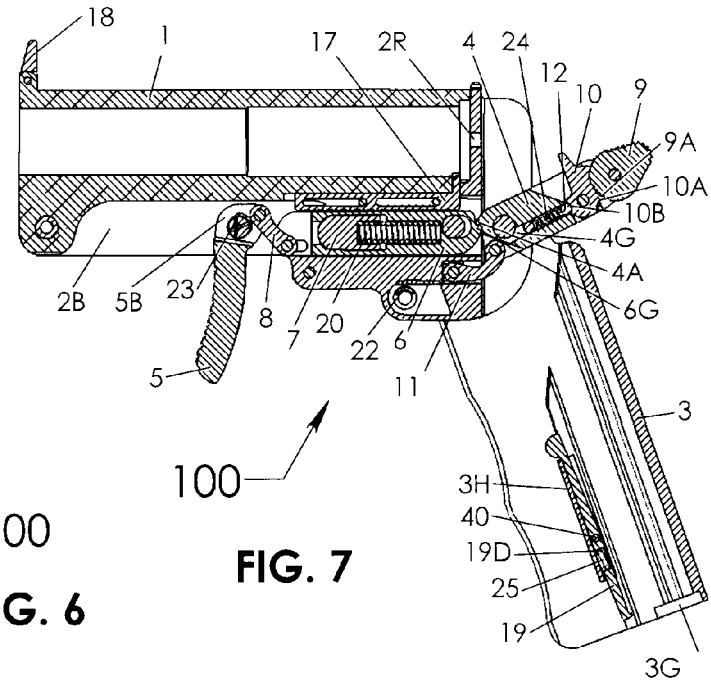
FIG. 7 is a cross sectional side view of the present invention in the firing position along lines 7-7 in FIG. 6.

Still referring to FIGS. 1 and 3, the firing surface 2P is connected to vertical sidewalls 2M and 2N, thereby forming a cavity for receiving the hammer 4. The firing surface 2P has a hole 2R as shown in FIGS. 6 and 7, which is of appropriate size to receive a firing pin 10 attached to the hammer 4. When the firing pin 10 engages the hole 2R of the firing surface 2P, it will strike a cartridge 43 loaded in the breech end 1B of the barrel 1 to fire the pistol 100 (see FIG. 8).

Referring to FIGS. 1, 7 and 10, an extractor 17 is slidably attached to the bottom surface of barrel 1 toward the breech end 1B. The extractor 17 is installed within a corresponding slot 1J visible in FIG. 10, formed along the bottom surface of the barrel 1. Referring to FIG. 1, the extractor 17 is generally L shaped with two slots 17A formed through the depth of the main horizontal body of extractor 17. Two extractor pins 41 are pressed into mounting holes (not shown) through the bottom surface of the barrel 1 in alignment with the clearance slots 17A through the extractor 17. The short leg 17B of the ejector 17 protrudes upward into a conforming slot 1K formed at the breech end 1B of the barrel 1. Referring to FIG. 10, the short leg 17B of the extractor 17 engages a rim 43A of a cartridge 43 as the extractor 17 is manually slid outward to raise the cartridge 43 from the barrel 1 so that the cartridge 43 can be grasped and removed from the barrel 1. The bottom surface of the extractor 17 is formed with small serrations to aid in gripping the extractor 17 while sliding outward from the barrel 1.

Referring to FIGS. 1 and 2, the frame 2 of the pistol 100 can be seen from a bottom perspective revealing the assembly relationship between the component parts of the pistol 100. Generally, the frame 2 is constructed of a hollow L shape. The frame 2 houses the component parts of the pistol 100. Towards the muzzle end 1C of the pistol 100, the frame 2 forms two parallel side members 2A and 2B in which the barrel 1 is mounted, as described above. The trigger 5 is also mounted between side members 2A and 2B.

Still referring to FIGS. 1 and 2, the frame 2 extends downward toward the breech end of the pistol 100 to form a lower rear portion of the frame 2, which houses grip locks 14 and 15. As shown in FIG. 1, a cavity 2J is formed through the frame 2 that is generally geometrically the same shape as the grip locks 14 and 15 in order to align with the handgrip 3 when the pistol 100 is in the open, firing position. Grip lock spring 22 is assembled between the grip locks 14 and 15 within the spring pocket 15A and an equal spring pocket (not shown) formed in grip lock 14, to retain a constant outward force. A formed contour 14B along the top surface of grip lock 14 serves as clearance for the hammer springs 21 to travel due to their close proximity within the frame 2. Grip lock 15 also includes the same clearance contour. Formed steps 14A and an equal formed step(not shown) on grip lock 15 engage the front edges 3A of the handgrip 3 to lock the handgrip 3 open in the firing position (see FIGS. 2 and 3). The rear portion of the frame 2 is formed at the intersection of vertical sidewalls 2M and 2N with side members 2A and 2B, respectively, to align with the top edges 3B of the handgrip 3 preventing further outward rotation of the handgrip 3 (see FIGS. 1 and 2). Simultaneously depressing both grip locks 14 and 15 together disengages them from the front edges 3A of the handgrip 3 and allows the handgrip 3 to pivot forward and close into the concealed position shown in FIGS. 4 and 5.

Referring to FIG. 1, the hammer 4 is mounted within the cavity formed by firing surface 2P and vertical sidewalls 2M and 2N. The hammer 4 is mounted with the hammer pin 32 pressed into the through holes 2L in the vertical sidewalls 2M and 2N, and through a corresponding clearance hole 4E in hammer 4.

Referring to FIGS. 1 and 2, the handgrip 3 is generally U-shaped and surrounds and is mounted to the rear lower portion of the frame 2 by the grip pin 30 which is inserted through clearance holes 3C in the handgrip 3, and pressed into the mounting holes 2K formed through the frame 2. The grip pin 30 also locates a latch 6 within the frame 2, as will be described below. The attachment of the handgrip 3 to the frame 2 by the grip pin 30 provides the pivot axis on which the handgrip 3 folds closed into the concealed position shown in FIGS. 4 and 5. The grip pin 30 has a small head that fits flush into a shallow counter-bore 3D formed along the circumference of the mounting hole 3C in the handgrip 3. The grip pin 30 is hollow and contains internal threads. A pin screw 31 contains external threads and threads into the grip pin 30 and fits flush with the outside of the handgrip 3 by resting in a shallow counter-bore (not shown) formed along the circumference of the mounting hole 3C of the handgrip 3.

In the open and firing position, the top edges 3B of the handgrip 3 contact the horizontal form at the rear of the frame 2, which is formed by the intersection of vertical sidewalls 2M and 2N with side members 2A and 2B, respectively, to stop outward pivotal rotation of the handgrip 3. At that point, the grip locks 14 and 15 are free to snap out from the frame cavity 2J into the locking positions and trap the handgrip 3 from forward rotation. The lower portion of the front edges 3A of the handgrip 3 are formed with subtle and shallow radius contours 3F that help to establish comfort and control finger gripping areas.

Referring to FIG. 1, grip inlays 16 are embedded within shallow pockets 3E formed within the surface of the handgrip 3 on substantially opposite sides thereof. The inlays 16 conform to the basic geometry of the handgrip 3 and serve to allow better traction handling on the pistol 100 to help prevent slipping or rotation of the pistol 100 while being fired. The current embodiment of the grip inlays 16 are constructed of wood, however any suitable materials such as plastics, carbon fibers, bone, leather, stone or other suitable materials may be substituted. However, in an alternative embodiment, the pistol 100 may not have any inlays 16.

Figure 4:
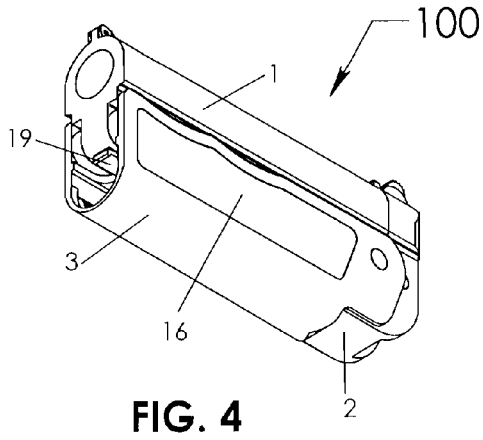
FIG. 4 is a front perspective view of the pistol of the present invention in the concealed position.
Figure 5:
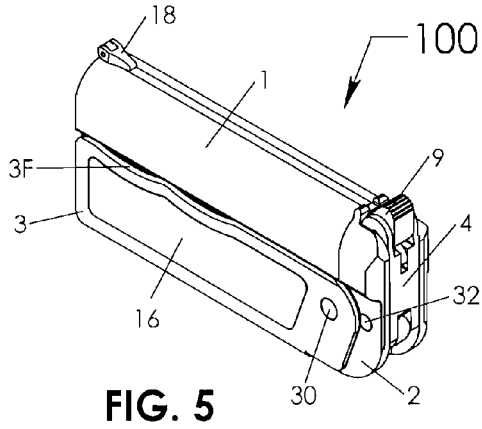
FIG. 5 is a rear perspective view of the pistol of the present invention in the concealed position.

Referring to FIG. 2, the handgrip 3 defines a hollow cavity therein, with the exception of a bullet clip 19 being placed in the cavity, as will be discussed below. The front portion of the U-shape handgrip 3 consists of thin parallel sides that surround and enclose a majority of the frame 2 when folded closed into the concealed position as shown in FIGS. 4 and 5.

Figure 8:
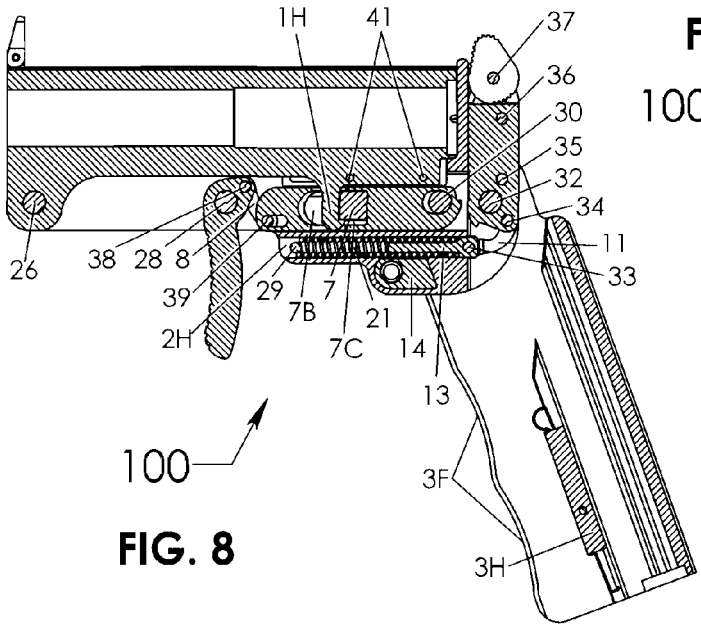
FIG. 8 is a cross sectional side view of the pistol of the present invention in the fired position along lines 8-8 in FIG. 9.
Figure 9:
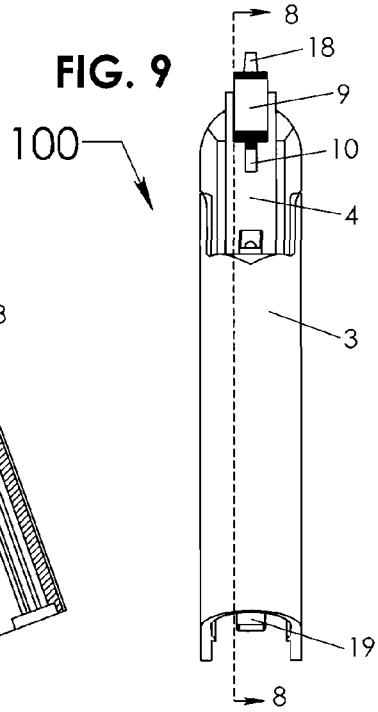
FIG. 9 is a rear view of the pistol of the present invention in the fired position.

Referring to FIG. 8, a cross section of the pistol 100 along lines 8-8 of FIG. 9 is disclosed. A thin mounting web 3H is formed into the handgrip 3 and disposed towards the center portion and toward the bottom of the handgrip 3. The web 3H and the back curved surface of the handgrip 3 define a chamber for holding a spare cartridge 43 (see FIGS. 10 and 11). The contour of the chamber formed by the inside of the handgrip 3 is of the appropriate diameter and shape to enable the insertion of the cartridge 43 to be stored as a spare. The bullet clip 19 is a lever type component mounted within web 3H. The bullet clip 19 secures the spare cartridge 43 contained inside the handgrip 3. Referring to FIG. 1, the bullet clip 19 has a small ridge 19A at the bottom edge that engages the groove of the rim 43A of a cartridge 43 (see FIG. 11) keeping the cartridge 43 in position within the chamber of the handgrip 3. A counter bore 3G (see FIG. 2) is formed into the bottom end of the handgrip 3 as clearance for the rim 43A of cartridge 43 and allows the cartridge to inserted flush with the bottom surfaces of the handgrip 3. At the opposing end of the bullet clip 19 is an embossment that serves as a button 19B which is depressed inside the handgrip 3 to release the spare cartridge 43. A bullet clip pin 40 is inserted within a clearance hole 19C in the body of the bullet clip 19 and pressed into a mounting hole 3J (see FIG. 1) that is formed through both side surfaces of the handgrip 3 as well as through the web 3H and is the pivot point at which the bullet clip 19 pivots. Referring to FIG. 7, a bullet spring 25 is located within a pocket 19D formed into the bullet clip 19 and opposes the web 3H within the handgrip 3, thereby biasing the tip of the bullet clip 19A toward the cartridge 43 to retain a constant downward force on the groove of the rim 43A of the cartridge 43. FIG. 11 illustrates a cartridge 43 as stored within the handgrip 3 while in the concealed configuration and a cartridge 43 loaded within the barrel 1.

Referring to FIG. 3, the hammer 4 is mounted within the vertical sidewalls 2M and 2N. The attachment of the hammer 4 to the frame 2 by the hammer pin 32 (see FIG. 8) provides the pivotal axis on which the hammer 4 rotates from the closed, safe position shown in FIGS. 5 and 11, to the cocked, firing position shown in FIGS. 2, 3 and 7. The firing pin 10 is mounted within a slot 4H formed in the hammer 4. The firing pin 10 is attached to the hammer 4 by an assembly pin 36 pressed into mounting holes 4J within the hammer 4 and through the central clearance hole within the firing pin 10 (see FIG. 1). The attachment of the firing pin 10 to the hammer 4 by the assembly pin 36 provides the pivotal axis on which the firing pin 10 rotates from the retracted, safe position within slot 4H shown in FIGS. 4 and 5 to the extended, firing position shown in FIGS. 3 and 7. The shape of the firing pin 10 is tapered to an acute angle towards the front, which forms to a small tip that is the actual striker area of the firing pin 10.

As shown in FIG. 7, the top surface of the firing pin 10 is formed with a series of teeth, or gears 10A that mesh with corresponding gears 9A formed along the bottom portion of a safety 9. The safety 9 is a triangular drum-shaped component that is mounted by an assembly pin 37 through the central clearance hole within the safety 9 and pressed into the mounting holes 4L within a top slot 4K formed in the hammer 4 (see FIG. 1). The relationship of the gears 9A of the safety 9 with gears 10A of the firing pin 10 causes the firing pin 10 to remain down in the safe position within the slot 4H in the hammer 4 as the safety 9 is being rotated back in conjunction with the hammer 4 during the cocking motion.

Referring to FIGS. 1, 7 and 8, the pistol 100 has a latch 6 that is disposed within the side members 2A and 2B of the frame 2, between the trigger 5 and the hammer 4. Referring to FIG. 1, the latch 6 has a notch 6G on its rear surface, a cavity 6C through the centerline for receiving a latch spring 20, a cavity 6D for receiving a barrel lock 7, and a slot 6A for receiving a toggle 8. Referring to FIGS. 7 and 8, the hammer 4 has a pawl 4A. Referring to FIG. 7, the pawl 4A of the hammer 4 engages with the notch 6G of the latch 6, locking the hammer 4 into the cocked position, at which time the safety 9 can be rotated forward, which in turn pivots the firing pin 10 outward from slot 4H into the firing position shown in FIGS. 3 and 7.

Referring to FIG. 1, the top surface of the firing pin 10 has an arc formed area 10C. The arc formed area 10C has no gears, and serves as a positive stop for the rotation of the firing pin 10 once the firing pin 10 has been rotated to the firing position. The arc formed area 10C also disperses some of the force of impact away from the firing pin mounting pin 36, and on the assembly pin 37 of the safety 9 during the actual engagement of the firing pin 10 with the cartridge 43 in the barrel 1. As shown in FIG. 7, formed along the bottom surface of the firing pin 10 are two radii 10B that orient the firing pin 10 to either the extended, firing position or the safe, retracted position. A ball bearing 12 conforms to both radii 10B and is spring loaded with the ball spring 24 to assure constant tension of the ball bearing 12 on the firing pin 10. The ball bearing 12 and the ball spring 24 are assembled inside a clearance hole 4G in the body of the hammer 4 and are held in place with an assembly pin 35 pressed into mounting holes 4F in the body of the hammer 4 (see FIG. 1).

Referring to FIGS. 1 and 8, the hammer 4 is energized by two hammer springs 21 that are housed in two spring pockets 2H within the bottom portion of the frame 2, below the latch 6. The front ends of the hammer springs 21 are retained by a retaining pin 29 which is pressed into mounting holes 2G through the frame 2 just rear of the trigger 5. The rear ends of the hammer springs 21 are fitted with two pistons 13 inserted within each hammer spring 21, as shown in FIGS. 1 and 8. A hammer toggle 11 is disposed between the pistons 13 and the hammer 4. The pistons 13 are attached to the hammer toggle 11 by a toggle pin 33 inserted through clearance holes 13A in the heads of both pistons 13 and a clearance hole 11B through the bottom portion of the hammer toggle 11. The bottom portion of hammer toggle 11 is necked down around the area of the clearance hole 13A for sufficient clearance to fit between the flattened areas on the heads of the pistons 13. The top portion of the hammer toggle 11 is located within a slot 4B of the hammer 4 and attached to the lower end of the hammer 4 by a toggle pin 34 inserted through clearance holes 4C of the hammer 4 and a clearance hole 11A in the hammer toggle 11. Manually pulling rearward on the hammer 4 causes the hammer 4 to rotate backward on the axis of the hammer pin 32 forcing the hammer toggle 11 frontward along with the pistons 13 to compress the hammer springs 21 as shown in FIG. 7.

Referring to FIGS. 1, 2 and 7, the trigger 5 is pivotally attached to the frame 2 within the two side members 2A and 2B by the trigger pin 28, which is pressed through mounting holes 2E in the side members 2A and 2B and through clearance hole 5A at the top portion of the trigger 5. The trigger pin 28 is the pivot axis on which the trigger 5 folds away inside the frame 2 between side members 2A and 2B while in the concealed position shown in FIG. 11. As shown in FIG. 1, a trigger spring 23 is a torsion spring that is assembled around the circumference of the undercut diameter 28A on the trigger pin 28. One end of the trigger spring 23 is anchored within a slot 28B formed approximately half way through the length of the trigger pin 28, while the other end of the trigger spring 23 rests against the bottom of a slot 5B formed through the top portion of the trigger 5 which biases the trigger 5 into a normally extended position. Because the trigger spring 23 has less force than the grip lock spring 22, it does not force the handgrip 3 open while the pistol 100 is in closed, concealed position shown in FIGS. 4, 5 and 11.

Referring to FIGS. 1 and 7, a trigger toggle 8 is positioned within a slot 5B formed in the upper portion of the trigger 5 and attached by a toggle pin 38 inserted through clearance holes 5C of the trigger 5 and clearance hole 8A of the trigger toggle 8. The trigger toggle 8 is disposed in slot 6A of the latch 6 and attached to the latch 6 by another toggle pin 39 inserted through a clearance hole 8B in the end of the trigger toggle 8 and a horizontal clearance slot 6B formed through the body of the latch 6.

Referring to FIG. 11, the latch 6 is shown in its relationship with the trigger toggle 8 while the pistol 100 is in the closed, concealed position. The latch 6 contains a horizontal clearance slot 6B in which the toggle pin 39 and trigger toggle 8 are free to float front to back, allowing the clearance needed for the trigger 5 to pivot from the retracted position when the pistol 100 is in the closed, concealed position (as shown in FIG. 11) to the extended position when the pistol 100 is in the open, firing position shown in FIG. 7.

Referring to FIGS. 1 and 7, through the centerline of the latch 6 is a cavity 6C which houses the latch spring 20 and opens into cavity 6D. The front of the latch spring 20 engages within a cavity 7A of the barrel lock 7 and pushes forward against the barrel lock 7 disposed in cavity 2F keeping the barrel lock 7 poised in the forward, locked position. The back of the latch spring 20 housed within cavity 6C, pushes rearward against the latch 6 biasing it rearward in the normally safe position illustrated in FIG. 7. As shown in FIG. 8, when the trigger 5 is pulled rearward, the toggle pin 39 engages the front surface of the horizontal clearance slot 6B within the latch 6 and in turn pulls the latch 6 forward, disengaging the hammer pawl 4A from the latch notch 6G, which releases the hammer 4 from the cocked position and allows the hammer 4 to rotate forward.

Referring to FIG. 1, the barrel lock 7 is housed within the cavity 6D in the latch 6 and corresponding barrel lock slots 2F in the side members 2A and 2B of the frame 2. Referring to FIGS.1 and 8, the barrel locking tabs 1H enter within the slots 7B of the barrel lock 7 and within the latch slots 6E on both the front and back surfaces of latch 6. In the locked position, the barrel lock tabs 1H of the barrel engage in the horizontal slots 7C formed perpendicular to latch slots 7B. FIG. 10 illustrates the latch 7 positioned in the rearward and unlatched position at which time the barrel locking tabs 1H are disengaged from the slots 7C of the barrel lock 7 and the barrel 1 is free to rotate to the open and reloading position. As the latch spring 20 biases the barrel lock 7 forward, in the normally locked position, it is necessary to slide the barrel lock 7 backward in order to disengage the locking tabs 1H of the barrel 1, from the barrel lock 7 (see FIGS. 1 and 8).

Referring to FIGS. 2 and 3, when the barrel 1 is locked by the barrel lock 7, both outer faces of the barrel lock 7 are flush with the outside surfaces of the frame 2. Barrel lock 7 is formed with serrations on both of its outer surfaces to allow for gripping the barrel lock 7. Referring to FIG. 10, disengaging the barrel lock slots 7C of the barrel lock 7 from the barrel locking tabs 1H is achieved by grasping the barrel lock 7 on the both outer serrated surfaces, and sliding the barrel lock 7 back towards the rear on the pistol 100. The barrel 1 may then be manually rotated open into the reloading position shown in FIG. 10.

Thus, a collapsible pistol 100 that is small, lightweight, and convenient to carry is disclosed. The pistol 100 is not limited to any particular size, caliber or number of cartridges, and can be configured for use with any desired caliber cartridges. Furthermore, although shown and described as having a single barrel 1 chambered for a single cartridge 43, the barrel 1 could be configured to chamber and fire two cartridges 43 sequentially, in which case the barrel 1 would be designed essentially as having two bores 1A formed parallel to each other in either an over and under or side by side configuration with an alternating firing pin 10 mechanism employed. Moreover, the invention could be configured to chamber and fire more than two cartridges in which case barrel 1 could be configured to chamber and fire 4 or more cartridges sequentially, where barrel 1 would be designed as having 4 or more bores 1A formed parallel to each other in a circular configuration incorporating an alternating or rotary type firing pin mechanism. Additionally, the invention could be configured as having one barrel 1 and bore 1A and incorporating a rotary or indexing chambering mechanism to allow for multiple cartridges 43 to be cycled through one barrel 1.

Although the invention has been described with reference to specific embodiments, this description is not meant to be construed in a limited sense. Various modifications of the disclosed embodiments, as well as alternative embodiments of the invention will become apparent to persons skilled in the art upon the reference to the description of the invention. It is, therefore, contemplated that the appended claims will cover such modifications that fall within the scope of the invention.

I claim:

1. A collapsible pistol comprising:

a frame having a receptacle for receiving a trigger therein and a firing surface disposed transverse said receptacle, said firing surface having a slot for receiving a firing pin;

a barrel being pivotally attached to said frame and having a bore extending longitudinally through said barrel and a breech end adjacent said firing surface;

a hammer pivotally attached to said frame adjacent said firing surface and being biased in an uncocked position and tensioned in a cocked position, said hammer having said firing pin attached thereto;

said trigger being retractably attached to said frame to be retracted into said receptacle when said pistol is in a collapsed position, and extended from said receptacle and communicating with said hammer to release said hammer from said cocked position when said pistol is in a firing position; and a handgrip pivotally attached to said frame below said breech end of said barrel to extend substantially downward from said frame when said pistol is in said firing position, and retract substantially parallel to and adjacent said barrel, and covering said trigger and a portion of said frame when said pistol is in said collapsed position.

2. The collapsible pistol as recited in claim 1 wherein:

said firing pin is pivotally attached to said hammer; and said hammer further comprises a cavity for receiving said firing pin and a safety pivotally attached to said hammer and communicating with said firing pin to retract said firing pin within said cavity and extend said firing pin from said cavity.

3. The collapsible pistol as recited in claim 2 further comprising:

a locking tab for locking said barrel to said frame, said locking tab being attached to a bottom surface of said barrel; and a locking tab receiving member slidably disposed within said frame for receiving and releasing said locking tab.

4. The collapsible pistol as recited in claim 3 further comprising:

a web surface disposed within and attached to said handgrip;

a lever attached to said web surface, said lever having a lip disposed on a lower portion thereof, said lower portion of said lever being biased away from said web surface;

said web surface and said lever defining a chamber within said handgrip for holding a spare bullet cartridge therein; and said lever holding said spare bullet cartridge in said chamber.

5. The collapsible pistol as recited in claim 4 further comprising:

two opposing handgrip locks depressibly disposed within said frame and adjacent said handgrip, said handgrip locks locking said handgrip in said firing position, and being depressed to release said handgrip to rotate said handgrip parallel to and adjacent said barrel in said collapsed position.

6. The collapsible pistol as recited in claim 5 wherein said handgrip locks further comprises a formed step for receiving a front edge of said handgrip to lock said handgrip in said firing position.

7. The collapsible pistol as recited in claim 6 further comprising:

an extractor slidably attached to said barrel and having a breech end extending to and substantially conforming with an inner surface of said barrel along said breech end of said barrel.

8. The collapsible pistol as recited in claim 7 further comprising:

a front sight pivotally attached to a muzzle end of said barrel on a top surface of said barrel;

a rear sight integral with the top edge of said firing surface; and wherein said front sight and said rear sight provide visual sights for aiming said pistol.

9. The collapsible pistol as recited in claim 8 wherein said handgrip further comprises an inlay disposed along an outer surface of said handgrip.

10. The collapsible pistol as recited in claim 9 further comprising:

a latch slidably disposed within said frame and having a cavity for receiving said barrel locking member, a spring disposed within said latch and adjacent said barrel locking member, and a notch for receiving a lower portion of said hammer when said hammer is in said cocked position;

a toggle pivotally attached to said latch and said trigger; and said latch releasing said hammer from said cocked position when said trigger is squeezed in a backward direction.

11. The collapsible pistol as recited in claim 1 further comprising:

a latch slidably disposed within said frame and having a cavity for receiving said barrel locking member, a spring disposed within said latch and adjacent said barrel locking member, and a notch for receiving a lower portion of said hammer when said hammer is in said cocked position;

a toggle pivotally attached to said latch and said trigger; and said latch releasing said hammer from said cocked position when said trigger is squeezed in a backward direction.

12. A collapsible pistol comprising:

a frame having two parallel horizontal side members defining a receptacle for receiving a trigger therein and a firing surface disposed transverse said side members, said firing surface having a slot for receiving a firing pin;

a barrel having a bore extending longitudinally through said barrel, a muzzle end and a breech end, said barrel being pivotally attached to said frame toward said muzzle end and said breech end being disposed adjacent said firing surface;

a hammer having a retractable firing pin disposed therein, said hammer being pivotally attached to said frame adjacent said firing surface and being biased in an uncocked position and tensioned in a cocked position;

said trigger being retractably attached to said side members of said frame to be retracted into said receptacle when said pistol is in a collapsed position, and extended from said receptacle when said pistol is in a firing position;

a latch slidably disposed within said frame between said side members, said latch having a notch for receiving a lower portion of said hammer when said hammer is in said cocked position and communicating with said trigger to release said hammer from said cocked position when said trigger is squeezed in a backward direction; and a handgrip pivotally attached to said frame below said breech end of said barrel to extend substantially downward from said frame when said pistol is in said firing position, and retract substantially parallel to and adjacent said barrel when said pistol is in said collapsed position.

13. The collapsible pistol as recited in claim 12 wherein said hammer further comprises:

a cavity for receiving said firing pin when said firing pin is retracted; and a safety pivotally attached to said hammer and communicating with said firing pin to retract said firing pin within said cavity and extend said firing pin from said cavity.

14. The collapsible pistol as recited in claim 13 further comprising:

locking tabs for locking said barrel to said frame, said locking tabs being attached to a bottom surface of said barrel; and a locking tab receiving member slidably disposed within said frame between said side members for receiving and releasing said locking tab.

15. The collapsible pistol as recited in claim 14 further comprising:

a web surface disposed within and attached to said handgrip;

a lever attached to said web surface, said lever having a lip disposed on a lower portion thereof, said lower portion of said lever being biased away from said web surface;

said web surface and said lever defining a chamber within said handgrip for holding a spare bullet cartridge therein; and said lever holding said spare bullet cartridge in said chamber.

16. The collapsible pistol as recited in claim 15 further comprising:

two opposing handgrip locks depressibly disposed within said frame, extending through said frame, and adjacent said handgrip, said handgrip locks locking said handgrip in said firing position, and being depressed to release said handgrip to rotate said handgrip parallel to and adjacent said barrel in said collapsed position.

17. The collapsible pistol as recited in claim 16 further comprising:

an extractor slidably attached to said barrel and having a breech end extending to and substantially conforming with a formed pocket of said barrel along said breech end of said barrel.

18. The collapsible pistol as recited in claim 17 further comprising:

a front sight pivotally attached to said muzzle end of said barrel on a top surface of said barrel;

a rear sight integral with the top edge of said firing surface; and wherein said front sight and said rear sight provide visual sights for aiming said pistol.

19. The collapsible pistol as recited in claim 18 wherein said handgrip further comprises an inlay disposed along an outer surface of said handgrip.

20. The collapsible pistol as recited in claim 19 wherein said horizontal side member of said frame further define two horizontal cavities parallel to and below said barrel for housing two compression springs therein, said compression springs being engaged with said hammer to compress when said hammer is said cocked position and to force said hammer to rotate to the firing position when said trigger is pulled.

* * * * *